US009864388B2

(12) United States Patent
Zhu et al.

(10) Patent No.: US 9,864,388 B2
(45) Date of Patent: Jan. 9, 2018

(54) REFERENCE VOLTAGE GENERATOR AND RELATED METHOD

(71) Applicants: Semiconductor Manufacturing International (Shanghai) Corporation, Shanghai (CN); Semiconductor Manufacturing International (Beijing) Corporation, Beijing (CN)

(72) Inventors: Kai Zhu, Shanghai (CN); Jie Chen, Shanghai (CN)

(73) Assignee: SEMICONDUCTOR MANUFACTURING INTERNATIONAL (SHANGHAI) CORPORATION (CN)

( * ) Notice: Subject to any disclaimer, the term of this patent is extended or adjusted under 35 U.S.C. 154(b) by 0 days.

(21) Appl. No.: 15/298,821

(22) Filed: Oct. 20, 2016

(65) Prior Publication Data

US 2017/0199538 A1 Jul. 13, 2017

(30) Foreign Application Priority Data

Jan. 12, 2016 (CN) ..... 2016 1 0016282

(51) Int. Cl.
*G05F 3/24* (2006.01)
*G05F 1/575* (2006.01)

(52) U.S. Cl.
CPC ..... *G05F 1/575* (2013.01); *G05F 3/24* (2013.01)

(58) Field of Classification Search
CPC ..... G05F 1/575; G05F 1/59; G05F 1/595
See application file for complete search history.

(56) References Cited

U.S. PATENT DOCUMENTS 8,952,675 B2 * 2/2015 Fort ..... G05F 3/30 323/313
2002/0014912 A1 * 2/2002 Riccio ..... G05F 1/465 327/541

(Continued)

FOREIGN PATENT DOCUMENTS

| | | |
|---|---|---|
| CN | 102623061 | 8/2012 |
| EP | 0291062 | 11/1988 |
| JP | 05-211426 | 8/1993 |

OTHER PUBLICATIONS

EP Search Report corresponding to European Patent Application No. 16207487.6, dated May 30, 2017, 10 pages.

*Primary Examiner* — Matthew Nguyen
(74) *Attorney, Agent, or Firm* — Innovation Counsel LLP

(57) ABSTRACT

A reference voltage generator may include the following elements: a first power supply terminal configured to receive a first power supply voltage; a second power supply terminal configured to receive a second power supply voltage; a reference voltage output node configured to provide a reference voltage; a first switch electrically connected between the first power supply terminal and the reference voltage output node; a second switch electrically connected between the second power supply terminal and the reference voltage output node; a first positive feedback module electrically connected to both the reference voltage output node and the first switch and configured to provide a first feedback voltage to the first switch; and a second positive feedback module electrically connected to both the reference voltage output node and the second switch and configured to provide a second feedback voltage to the second switch.

15 Claims, 5 Drawing Sheets

(56) References Cited

U.S. PATENT DOCUMENTS

| | | | | |
|---|---|---|---|---|
| 2007/0296487 | A1 | 12/2007 | Kuriyama | |
| 2011/0050197 | A1 * | 3/2011 | Yuasa | G05F 3/242 323/313 |

* cited by examiner

REFERENCE VOLTAGE GENERATOR AND RELATED METHOD

CROSS-REFERENCE TO RELATED APPLICATION

This application claims priority to and benefit of Chinese Patent Application No. 201610016282.3, filed on 12 Jan. 2016; the Chinese Patent Application is incorporated herein by reference in its entirety.

BACKGROUND OF THE INVENTION

The technical field is related to a reference voltage generator and a method of operating the reference voltage generator.

A reference voltage generator may include two resistors connected in series between two power supplies and may be used for providing a reference voltage to a load. A level of the reference voltage provided by the reference voltage generator may depend on the resistance proportion of the two resistors. In order to make a static current associated with the reference voltage generator to be acceptably low, the resistance values of the two resistors may need to be sufficiently high. To save layout size, resistor can be replaced by serial MOS transistors in diode connection and with low W/L, in which W is width of MOS and L is channel length of MOS. Nevertheless, when the reference voltage by reference voltage generator is on a load, some electrical characteristics of the load may cause the value of the reference voltage to deviate from its base value (or target value), e.g., an output driver of IO circuit as a load may shift the reference voltage by transient current coupling through equivalent capacitance of the driver. If the resistance values of the two resistors are substantially high, a significantly long time may be required for the reference voltage to return to the base value. An incorrect reference voltage may be undesirably provided during this long period.

SUMMARY

An embodiment may be related to a reference voltage generator. The reference voltage generator may include a first power supply terminal, a second power supply terminal, a reference voltage output node, a first switch, a second switch, a first positive feedback module, and a second positive feedback module. The first power supply terminal may receive a first power supply voltage. The second power supply terminal may receive a second power supply voltage. The reference voltage output node may provide a reference voltage. A first terminal of the first switch may be electrically connected to the first power supply terminal. A second terminal of the first switch may be electrically connected to the reference voltage output node. A first terminal of the second switch may be electrically connected to the second power supply terminal. A second terminal of the second switch may be electrically connected to the reference voltage output node. A first input node of the first positive feedback module may be electrically connected to the reference voltage output node. An output node of the first positive feedback module may be electrically connected to a control electrode of the first switch for providing a first feedback voltage to the control electrode of the first switch. A first input node of the second positive feedback module may be electrically connected to the reference voltage output node. An output node of the second positive feedback module may be electrically connected to a control electrode of the second switch for providing a second feedback voltage to the control electrode of the second switch.

The first feedback module may provide the first feedback voltage with a base first feedback voltage value such that conductance of the first switch has a base first conductance value when the reference voltage has a base reference voltage value. The first positive feedback module may provide the first feedback voltage with an increased first feedback voltage value such that the conductance of the first switch has a decreased first conductance value when the reference voltage has an increased reference voltage value. The increased reference voltage value may be higher than the base reference voltage value. The increased first feedback voltage value may be higher than the base first feedback voltage value. The decreased first conductance value may be lower than the base first conductance value.

The second feedback module may provide the second feedback voltage with a base second feedback voltage value such that a conductance of the second switch has a base second conductance value when the reference voltage has the base reference voltage value. The second positive feedback module may provide the second feedback voltage with an increased second feedback voltage value such that the conductance of the second switch has an increased second conductance value when the reference voltage has an increased reference voltage value. The increased reference voltage value may be higher than the base reference voltage value. The increased second feedback voltage value may be higher than the base second feedback voltage value. The increased second conductance value may be higher than the base second conductance value.

The first positive feedback module may provide the first feedback voltage with a decreased first feedback voltage value such that the conductance of the first switch has an increased first conductance value when the reference voltage has a decreased reference voltage value. The decreased reference voltage value may be lower than the base reference voltage value. The decreased first feedback voltage value may be lower than the base first feedback voltage value. The increased first conductance value may be higher than the base first conductance value.

The second positive feedback module may provide the second feedback voltage with a decreased second feedback voltage value such that the conductance of the second switch has a decreased second conductance value when the reference voltage has the decreased reference voltage value. The decreased reference voltage value may be lower than the base reference voltage value. The decreased second feedback voltage value may be lower than the base second feedback voltage value. The decreased second conductance value may be lower than the base second conductance value.

The first power supply terminal and the second power supply terminal may provide a first power voltage difference using the first power supply voltage and the second power supply voltage. One or more of a maximum allowable voltage of the first switch and a maximum allowable voltage of the second switch may be lower than the first power voltage difference.

The first input node of the first positive feedback module may receive a first copy of the reference voltage. A second input node of the first positive feedback module may receive a first copy of a comparison voltage. The first positive feedback module may generate the first feedback voltage based on a comparison between the first copy of the reference voltage and the first copy of the comparison voltage. The first input node of the second positive feedback module may receive a second copy of the reference voltage. A second input node of the second positive feedback module may receive a second copy of the comparison voltage. The second positive feedback module may generate the second feedback voltage based on a comparison between the second copy of the reference voltage and the second copy of the comparison voltage.

The first positive feedback module may provide the first feedback voltage with a first feedback voltage value equal to a value of the first power supply voltage minus a value of a threshold voltage of the first switch. The second positive feedback module may provide the second feedback voltage with a second feedback voltage value equal to a value of a threshold voltage of the second switch plus the second power supply voltage.

The first positive feedback module may include the following elements: a first connection node; a second connection node; a first p-channel transistor, which may be electrically connected between the output node of the first positive feedback module and the first connection node; a second p-channel transistor, which may be electrically connected between the output node of the first positive feedback module and the first power supply terminal; a third p-channel transistor, which may be electrically connected between the second connection node and the first connection node; a fourth p-channel transistor, which may be electrically connected between the second connection node and the first power supply terminal; and a current source, which may be electrically connected between the first connection node and the second power supply terminal. A gate terminal of the first p-channel transistor functions as the first input node of the first positive feedback module for receiving a copy of the reference voltage. A gate terminal of the third p-channel transistor functions as a second input node of the first positive feedback module for receiving a copy of a comparison voltage. A gate terminal of the second p-channel transistor may be electrically connected to the second connection node. A gate terminal of the fourth p-channel transistor may be electrically connected to the output node of the first positive feedback module.

The current source may be/include an n-channel transistor.

The first power supply terminal and the second power supply terminal may provide a first power voltage difference using the first power supply voltage and the second power supply voltage. One or more of a maximum allowable voltage of the first p-channel transistor, a maximum allowable voltage of the second p-channel transistor, a maximum allowable voltage of the third p-channel transistor, and a maximum allowable voltage of the fourth p-channel transistor and a maximum allowable voltage of n-channel transistor as current source may be lower than the first power voltage difference.

The second positive feedback module may include the following elements: a first junction node; a second junction node; a first n-channel transistor, which may be electrically connected between the output node of the second positive feedback module and the first junction node; a second n-channel transistor, which may be electrically connected between the output node of the second positive feedback module and the second power supply terminal; a third n-channel transistor, which may be electrically connected between the second junction node and the first junction node; a fourth n-channel transistor, which may be electrically connected between the second junction node and the second power supply terminal; and a current source, which may be electrically connected between the first junction node and the first power supply terminal. A gate terminal of the first n-channel transistor functions as the first input node of the second positive feedback module for receiving a copy of the reference voltage. A gate terminal of the third n-channel transistor functions as a second input node of the second positive feedback module for receiving a copy of a comparison voltage. A gate terminal of the second n-channel transistor may be electrically connected to the second junction node. A gate terminal of the fourth n-channel transistor may be electrically connected to the output node of the second positive feedback module.

The current source may be/include a p-channel transistor.

The first power supply terminal and the second power supply terminal may provide a first power voltage difference using the first power supply voltage and the second power supply voltage. One or more of a maximum allowable voltage of the first n-channel transistor, a maximum allowable voltage of the second n-channel transistor, a maximum allowable voltage of the third n-channel transistor, and a maximum allowable voltage of the fourth n-channel transistor and a maximum allowable voltage of p-channel transistor as current source may be lower than the first power voltage difference.

The reference voltage generator may include a comparison voltage generator, which may be electrically connected to both a second input node of the first positive feedback module and a second input node of the second positive feedback module and may provide a comparison voltage. The second input node of the first positive feedback module may receive a first copy of the comparison voltage. The second input node of the second positive feedback module may receive a second copy of the comparison voltage.

The comparison voltage generator may include a plurality of diodes or a plurality of resistors. The diodes or the resistors may be electrically connected in series between the first power supply terminal and the second power supply terminal.

An embodiment may be related to a method of operating a reference voltage generator. The method may include the following steps: providing a first power supply voltage to a first power supply terminal of the reference voltage generator; providing a second power supply voltage to a second power supply terminal of the reference voltage generator; providing a reference voltage from a reference voltage output node of the reference voltage generator;

providing a first feedback voltage from an output node of a first positive feedback module to a control electrode of a first switch; and providing a second feedback voltage from an output node of a second positive feedback module to a control electrode of a second switch. A first input node of the first positive feedback module may be electrically connected to the reference voltage output node. The output node of the first positive feedback module may be electrically connected to the control electrode of the first switch. A first terminal of the first switch may be electrically connected to the first power supply terminal. A second terminal of the first switch may be electrically connected to the reference voltage output node. A first input node of the second positive feedback module may be electrically connected to the reference voltage output node. The output node of the second positive feedback module may be electrically connected to the control electrode of the second switch. A first terminal of the second switch may be electrically connected to the second power supply terminal. A second terminal of the second switch may be electrically connected to the reference voltage output node.

The reference voltage generator may include a comparison voltage generator, which may be electrically connected to both a second input node of the first positive feedback module and a second input node of the second positive feedback module and may provide a comparison voltage. The second input node of the first positive feedback module may receive a first copy of the comparison voltage. The second input node of the second positive feedback module may receive a second copy of the comparison voltage.

According to embodiments, although maximum allowable voltages of components (e.g., transistors) in a reference voltage generator may be lower than a power voltage difference, the components may operate under respective maximum allowable voltages, such that the reference voltage generator may operate reliably. According to embodiments, when a reference voltage provided by a reference voltage generator deviates from a base value of the reference voltage, the reference voltage generator may effectively and efficiently restore the reference voltage to the base value using positive feedback mechanisms. Advantageously, a substantially consistent and/or stable reference voltage may be provided.

The above summary is related to some of many embodiments of the invention disclosed herein and is not intended to limit the scope of the invention.

DETAILED DESCRIPTION

Figure 1:
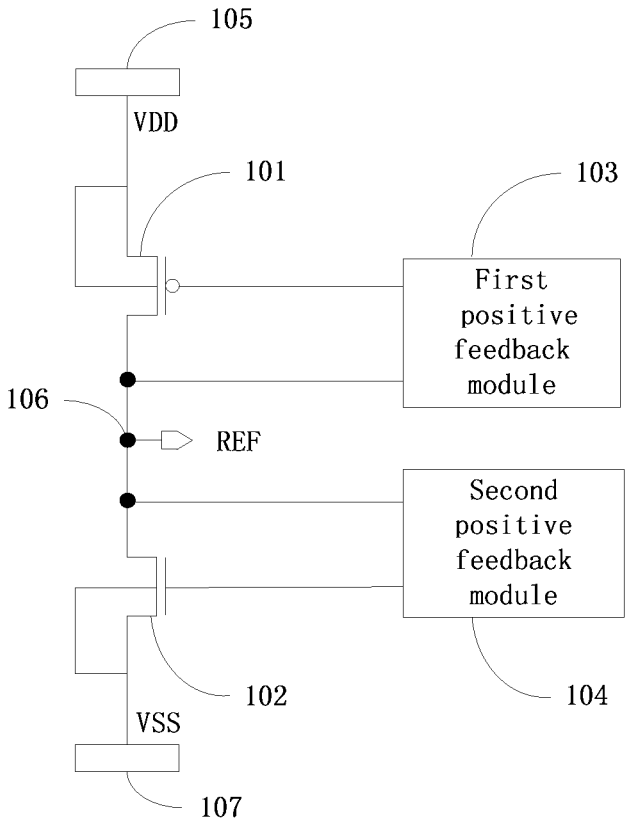
FIG. 1 shows a schematic diagram (e.g., a schematic circuit diagram) that illustrates elements and/or structures in a reference voltage generator in accordance with one or more embodiments.

Example embodiments are described with reference to the accompanying drawings. As those skilled in the art would realize, the described embodiments may be modified in various different ways, all without departing from the spirit or scope. Embodiments may be practiced without some or all of these specific details. Well known process steps and/or structures may not have been described in detail in order to not unnecessarily obscure described embodiments.

The drawings and description are illustrative and not restrictive. Like reference numerals may designate like (e.g., analogous or identical) elements in the specification. Repetition of description may be avoided.

The relative sizes and thicknesses of elements shown in the drawings are for facilitate description and understanding, without limiting possible embodiments. In the drawings, the thicknesses of some layers, films, panels, regions, etc., may be exaggerated for clarity.

Illustrations of example embodiments in the figures may represent idealized illustrations. Variations from the shapes illustrated in the illustrations, as a result of, for example, manufacturing techniques and/or tolerances, may be possible. Thus, the example embodiments should not be construed as limited to the shapes or regions illustrated herein but are to include deviations in the shapes. For example, an etched region illustrated as a rectangle may have rounded or curved features. The shapes and regions illustrated in the figures are illustrative and should not limit the scope of the example embodiments.

Although the terms "first", "second", etc. may be used herein to describe various elements, these elements should not be limited by these terms. These terms may be used to distinguish one element from another element. Thus, a first element discussed in this application may be termed a second element without departing from embodiments. The description of an element as a "first" element may not require or imply the presence of a second element or other elements. The terms "first", "second", etc. may also be used herein to differentiate different categories or sets of elements. For conciseness, the terms "first", "second", etc. may represent "first-category (or first-set)", "second-category (or second-set)", etc., respectively.

If a first element (such as a layer, film, region, or substrate) is referred to as being "on", "neighboring", "connected to", or "coupled with" a second element, then the first element can be directly on, directly neighboring, directly connected to, or directly coupled with the second element, or an intervening element may also be present between the first element and the second element. If a first element is referred to as being "directly on", "directly neighboring", "directly connected to", or "directed coupled with" a second element, then no intended intervening element (except environmental elements such as air) may be provided between the first element and the second element.

Spatially relative terms, such as "beneath", "below", "lower", "above", "upper", and the like, may be used herein for ease of description to describe one element or feature's spatial relationship to another element(s) or feature(s) as illustrated in the figures. It will be understood that the spatially relative terms may encompass different orientations of the device in use or operation in addition to the orientation depicted in the figures. For example, if the device in the figures is turned over, elements described as "below" or "beneath" other elements or features would then be oriented "above" the other elements or features. Thus, the term "below" can encompass both an orientation of above and below. The device may be otherwise oriented (rotated 90 degrees or at other orientations), and the spatially relative descriptors used herein should be interpreted accordingly.

The terminology used herein is for the purpose of describing particular embodiments and is not intended to limit the embodiments. As used herein, the singular forms, "a", "an", and "the" may indicate plural forms as well, unless the context clearly indicates otherwise. The terms "includes" and/or "including", when used in this specification, may specify the presence of stated features, integers, steps, operations, elements, and/or components, but may not preclude the presence or addition of one or more other features, integers, steps, operations, elements, components, and/or groups.

Unless otherwise defined, terms (including technical and scientific terms) used herein have the same meanings as commonly understood by one of ordinary skill in the art. Terms, such as those defined in commonly used dictionaries, should be interpreted as having meanings that are consistent with their meanings in the context of the relevant art and should not be interpreted in an idealized or overly formal sense unless expressly so defined herein.

The term "connect" may mean "electrically connect", "directly connect", or "indirectly connect". The term "insulate" may mean "electrically insulate". The term "conductive" may mean "electrically conductive". The term "electrically connected" may mean "electrically connected without any intervening transistors". If a component (e.g., a transistor) is described as connected between a first element and a second element, then a source/drain/input/output terminal of the component may be electrically connected to the first element through no intervening transistors, and a drain/source/output/input terminal of the component may be electrically connected to the second element through no intervening transistors.

The term "conductor" may mean "electrically conductive member". The term "insulator" may mean "electrically insulating member". The term "dielectric" may mean "dielectric member". The term "interconnect" may mean "interconnecting member". The term "provide" may mean "provide and/or form". The term "form" may mean "provide and/or form".

Unless explicitly described to the contrary, the word "comprise" and variations such as "comprises", "comprising", "include", or "including" may imply the inclusion of stated elements but not the exclusion of other elements.

Various embodiments, including methods and techniques, are described in this disclosure. Embodiments may also cover an article of manufacture that includes a non-transitory computer readable medium on which computer-readable instructions for carrying out embodiments of the inventive technique are stored. The computer readable medium may include, for example, semiconductor, magnetic, opto-magnetic, optical, or other forms of computer readable medium for storing computer readable code. Further, embodiments may also cover apparatuses for practicing embodiments. Such apparatus may include circuits, dedicated and/or programmable, to carry out operations pertaining to embodiments. Examples of such apparatus include a general purpose computer and/or a dedicated computing device when appropriately programmed and may include a combination of a computer/computing device and dedicated/programmable hardware circuits (such as electrical, mechanical, and/or optical circuits) adapted for the various operations pertaining to embodiments.

FIG. 1 shows a schematic diagram (e.g., a schematic circuit diagram) that illustrates elements and/or structures in a reference voltage generator in accordance with one or more embodiments. The reference voltage generator may include a first switch 101, a second switch 102, a first positive feedback module 103, a second positive feedback module 104, a first power supply terminal 105, a second power supply terminal 107, and a reference voltage output node 106. The reference voltage output node 106 may be connected to a load for providing a first copy of a reference voltage REF to the load. The load may be, for example, a capacitive load or a resistive load.

The first switch 101 may be connected between the first power supply terminal 105 and the reference voltage output node 106. The first switch 101 may be/include a p-channel metal-oxide-semiconductor (PMOS) transistor.

The second switch 102 may be connected between the second power supply terminal 107 and the reference voltage output node 106. The second switch 102 may be/include an n-channel metal-oxide-semiconductor (NMOS) transistor.

The first positive feedback module 103 may receive a second copy of the reference voltage REF and may provide a first feedback voltage to the first switch 101 for controlling the conductance of the first switch 101. When the reference voltage REF increases (or is higher), the first feedback voltage may increase (or may be higher), such that the conductance of the first switch 101 may decrease (or may be lower). When the reference voltage REF decreases (or is lower), the first feedback voltage may decrease (or may be lower), such that the conductance of the first switch 101 may increase (or may be higher).

The second positive feedback module 104 may receive a third copy of the reference voltage REF and may provide a second feedback voltage to the second switch 102 for controlling the conductance of the second switch 102. When the reference voltage REF increases (or is higher), the second feedback voltage may increase (or may be higher), such that the conductance of the second switch 102 may increase (or may be higher). When the reference voltage decreases (or is lower), the second feedback voltage may decrease (or may be lower), such that the conductance of the second switch 102 may decrease (or may be lower).

The first power supply terminal 105 may receive a first power supply voltage VDD (e.g., 3.3 V), the second power supply terminal 107 may receive a second power supply voltage VSS (e.g., 0 V), such that a first power voltage difference (e.g., 3.3 V) may be provided between the first power supply terminal 105 and the second power supply terminal 107. The maximum allowable voltage of the first switch 101 and/or the maximum allowable voltage of the second switch 102 may be lower than the first power voltage difference. In an embodiment, the first power voltage difference may be 3.3 V, the maximum allowable voltage of the first switch 101 may be 1.8 V, and the maximum allowable voltage of the second switch 102 may be 1.8 V.

The first feedback voltage may be substantially equal to VDD minus Vtp, and the second feedback voltage may be substantially equal to Vtn plus VSS, wherein VDD is the first power supply voltage, Vtp is a threshold voltage of the first switch 101, and Vtn is a threshold voltage of the second switch.

In a method of operating the reference voltage generator, when the reference voltage REF increases (or is higher), the first feedback voltage may increase (or may be higher) to cause the conductance of the first switch 101 to decrease (or to be lower), and the second feedback voltage may increase (or may be higher) to cause the conductance of the second switch 102 to increase (or to be higher). As a result, the reference voltage REF may decrease and may return to a base value (e.g., a target value) of the reference voltage REF.

In a method of operating the reference voltage generator, when the reference voltage REF decreases (or is lower), the first feedback voltage may decrease (or may be lower) to cause the conductance of the first switch 101 to increase (or to be higher), and the second feedback voltage may decrease (or may be lower) to cause the conductance of the second switch 102 to decrease (or to be lower). As a result, the reference voltage REF may increase and may return to a base value (e.g., a target value) of the reference voltage REF.

According to embodiments, through providing the first feedback voltage and the second feedback voltage, the first positive feedback module 103 and the second positive feedback module 104 may enable the reference voltage REF to efficiently and effectively return to a base value (e.g., a target value) of the reference voltage REF.

According to embodiments, the first positive feedback module 103 may provide a first feedback voltage to the first switch 101 based on a comparison between the reference voltage REF and a comparison voltage, and/or the second positive feedback module 104 may provide a second feedback voltage to the second switch 102 based on a comparison between the reference voltage REF and a comparison voltage.

Figure 2:
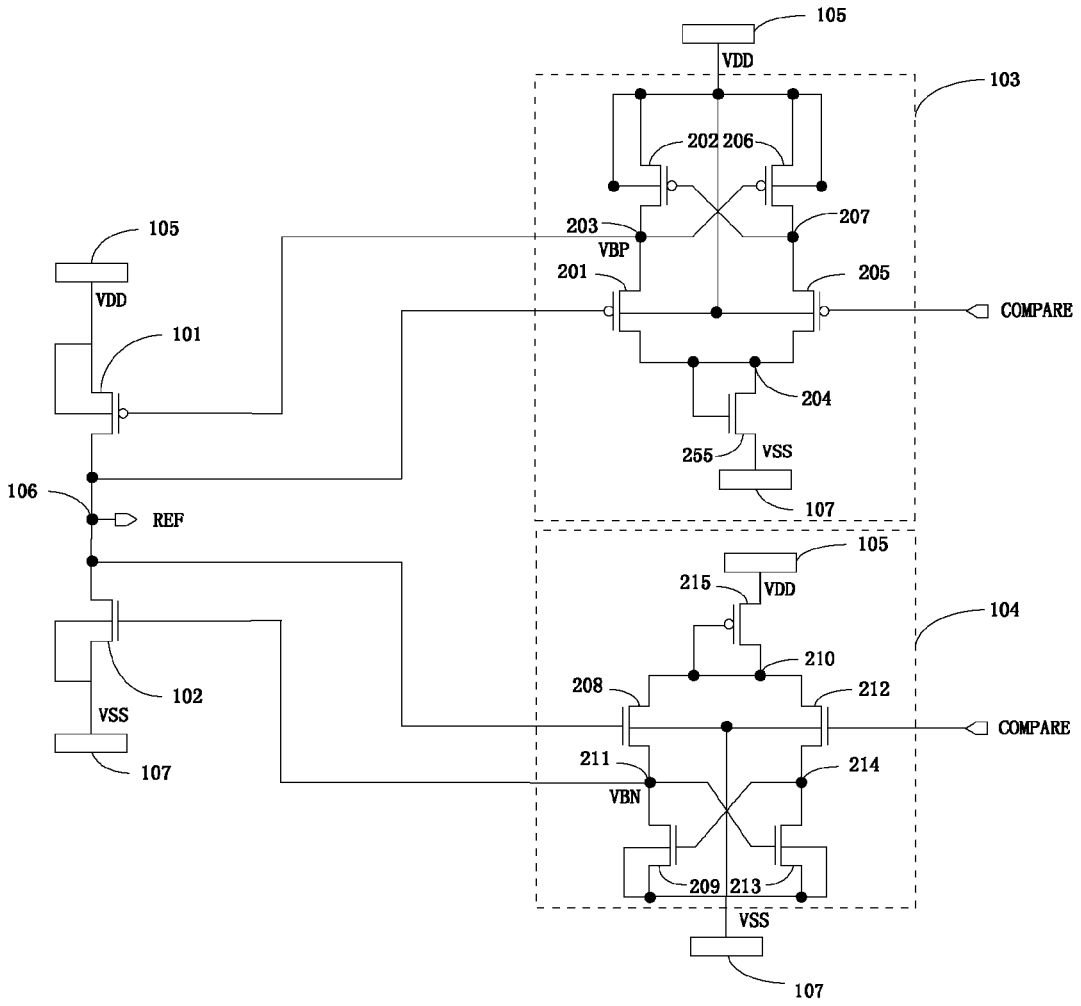
FIG. 2 shows a schematic diagram (e.g., a schematic circuit diagram) that illustrates elements and/or structures in a reference voltage generator in accordance with one or more embodiments.
Figure 3:
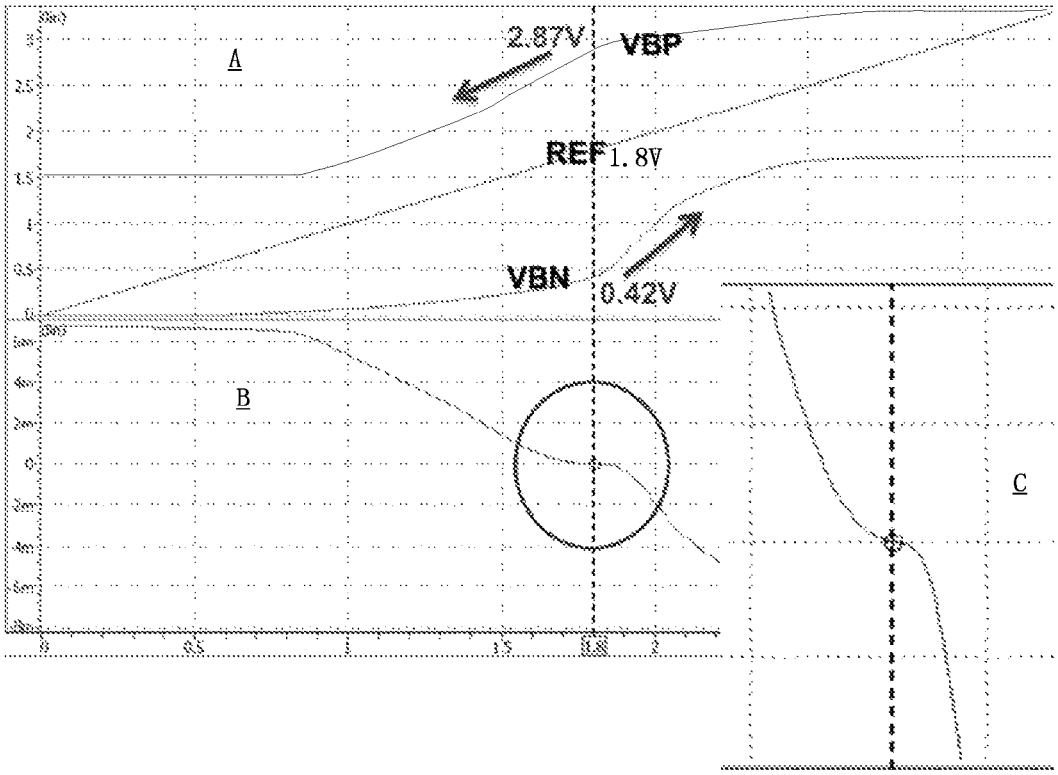
FIG. 3 shows a schematic diagram that illustrates voltages involved in a method of operating a reference voltage generator in accordance with one or more embodiments.

FIG. 2 shows a schematic diagram (e.g., a schematic circuit diagram) that illustrates elements and/or structures in a reference voltage generator in accordance with one or more embodiments. FIG. 3 shows a schematic diagram that illustrates voltages involved in a method of operating the reference voltage generator in accordance with one or more embodiments. Some features of the reference voltage generator may be analogous to or identical to some features described with reference to the example of FIG. 1. Referring to FIG. 2, the first positive feedback module 103 may be/include a first differential amplifier, and the second positive feedback module 104 may be/include a second differential amplifier. A first input node of the first differential amplifier may be connected to the reference voltage output node 106, a second input node of the first differential amplifier may receive a first copy of a comparison voltage COMPARE, and an output node 203 of the first differential amplifier may be connected to a control node (e.g., a gate node) of the first switch 101 for providing a first feedback voltage VBP to the first switch 101. A first input node of the second differential amplifier may be connected to the reference voltage output node 106, a second input node of the second differential amplifier may receive a second copy of the comparison voltage COMPARE, and an output node 211 of the second differential amplifier may be connected to a control node (e.g., a gate node) of the second switch 102 for providing a second feedback voltage VBN to the second switch 102.

The first positive feedback module 103 (and/or the first differential amplifier) may include a first circuit (e.g., a left circuit), a second circuit (e.g., a right circuit), and a first current source 255.

The first circuit may include a first p-channel transistor 201 (e.g., a PMOS transistor) and a second p-channel transistor 202 (e.g., a PMOS transistor). The first p-channel transistor 201 may be connected between the output node 203 and a connection node 204. The second p-channel transistor 202 may be connected between the output node 203 and the first power supply terminal 105.

The second circuit may include a third p-channel transistor 205 (e.g., a PMOS transistor) and a fourth p-channel transistor 206 (e.g., a PMOS transistor). The third p-channel transistor 205 may be connected between a connection node 207 and the connection node 204. The fourth p-channel transistor 206 may be connected between the connection node 207 and the first power supply terminal 105.

The first current source 255 may be connected between the connection node 204 and the second power supply terminal 107. The first current source 255 may be/include an n-channel transistor (e.g., an NMOS transistor).

In the first positive feedback module 103, the gate terminal of the first p-channel transistor 201 may function as the first input node for receiving a copy of the reference voltage REF, the gate terminal of the third p-channel transistor 205 may function as the second input node for receiving a copy of the comparison voltage COMPARE, the gate terminal of the second p-channel transistor 202 may be connected to the connection node 207, the gate terminal of the fourth p-channel transistor 206 may be connected to the output node 203, and the output node 203 may provide the first feedback voltage VBP to the first switch 101.

One or more of a maximum allowable voltage of the first p-channel transistor 201, a maximum allowable voltage of the second p-channel transistor 202, a maximum allowable voltage of the third p-channel transistor 205, and a maximum allowable voltage of the fourth p-channel transistor 206 may be lower than the first power voltage difference. However, the components may operate under respective maximum allowable voltages in this structure, such that the components in the first positive feedback module 103 may operate reliably.

In an embodiment, each of the transistors 201, 202, 205, 206, and 255 in the first positive feedback module 103 may have a threshold voltage of about 0.5 V, the comparison voltage COMPARE may be about 1.65 V, the reference voltage REF may be at a base value, e.g., a steady-state value, such as 1.8 V. The first p-channel transistor 201, the second p-channel transistor 202, and the first current source 255 may be on (i.e., may be conductive). The third p-channel transistor 205 and the fourth p-channel transistor 206 may be off (i.e., may be insulating). The first feedback voltage VBP provided at the output node 203 may be about 2.87 V.

Referring to FIG. 2 and FIG. 3, when the reference voltage REF decreased below 1.8 V (with the first current source 255 remaining on), the conductance of the first p-channel transistor 201 may increase, such that the first feedback voltage VBP provided at the output node 203 may decrease. In response, the conductance of the fourth p-channel transistor 206 may increase, such that the voltage at the connection node 207 may increase. In response, the conductance of the second p-channel transistor 202 may decrease, such that the first feedback voltage VBP at the output node 203 may decrease below 2.87 V (e.g., toward 2.3 V). In response, the conductance of the first switch 101 may increase, such that the reference voltage REF may increase (i.e., may be pulled up) to substantially return to the base value 1.8 V.

Referring to FIG. 2 and FIG. 3, when the reference voltage REF increases above 1.8 V (with the first current source 255 remaining on), the conductance of the first p-channel transistor 201 may decrease, such that the first feedback voltage VBP provided at the output node 203 may increase. In response, the conductance of the fourth transistor p-channel 206 may decrease, such that the voltage at the connection node 207 may decrease. In response, the conductance of the second p-channel transistor 202 may increase, such that the first feedback voltage VBP at the output node 203 may increase above 2.87 V. In response, the conductance of the first switch 101 may decrease, such that the reference voltage REF may decrease (i.e., may be pulled down) to substantially return to the base value 1.8 V.

According to different amplification factors, the change of the first feedback voltage VBP may be different from (e.g., greater than) the change of the reference voltage REF.

Referring to FIG. 2, the second positive feedback module 104 (and/or the second differential amplifier) may include a third circuit (e.g., a left circuit), a fourth circuit (e.g., a right circuit), and a second current source 215.

The third circuit may include a first n-channel transistor 208 (e.g., an NMOS transistor) and a second n-channel transistor 209 (e.g., an NMOS transistor). The first n-channel transistor 208 may be connected between the output node 211 and a junction node 210. The second n-channel transistor 209 may be connected between the output node 211 and the second power supply terminal 107.

The fourth circuit may include a third n-channel transistor 212 (e.g., an NMOS transistor) and a fourth n-channel transistor 213 (e.g., an NMOS transistor). The third n-channel transistor 212 may be connected between a junction node 214 and the junction node 210. The fourth n-channel transistor 213 may be connected between the junction node 214 and the second power supply terminal 107.

The second current source 215 may be connected between the junction node 210 and the first power supply terminal 105. The second current source 215 may be/include a p-channel transistor (e.g., a PMOS transistor).

In the second positive feedback module 104, the gate terminal of the first n-channel transistor 208 may function as the first input node for receiving a copy of the reference voltage REF, the gate terminal of the third n-channel transistor 212 may function as the second input node for receiving a copy of the comparison voltage COMPARE, the gate terminal of the second n-channel transistor 209 may be connected to the junction node 214, the gate terminal of the fourth n-channel transistor 213 may be connected to the output node 211, and the output node 211 may provide the second feedback voltage VBN to the second switch 102.

One or more of a maximum allowable voltage of the first n-channel transistor 208, a maximum allowable voltage of the second n-channel transistor 209, a maximum allowable voltage of the third n-channel transistor 212, and a maximum allowable voltage of the fourth n-channel transistor 213 may be lower than the first power voltage difference. However, the components may operate under respective maximum allowable voltages in this structure, such that the components in the second positive feedback module 104 may operate reliably.

In an embodiment, each of the transistors 208, 209, 212, 213, and 215 in the second positive feedback module 104 may have a threshold voltage of about 0.5 V, the comparison voltage COMPARE may be about 1.65 V, the reference voltage REF may be at a base value, e.g., a steady-state value, such as 1.8 V. The first n-channel transistor 208, the second n-channel transistor 209, the third n-channel transistor 212, and the second current source 215 may be on (i.e., may be conductive). The fourth n-channel transistor 213 may be off (i.e., may be insulating). The second feedback voltage VBN provided at the output node 211 may be about 0.42 V.

Referring to FIG. 2 and FIG. 3, when the reference voltage REF decreased below 1.8 V (with the second current source 215 remaining on), the conductance of the first n-channel transistor 208 may decrease, such that the second feedback voltage VBN provided at the output node 211 may decrease. In response, the conductance of the fourth n-channel transistor 213 may decrease, such that the voltage at the junction node 214 may increase. In response, the conductance of the second n-channel transistor 209 may increase, such that the second feedback voltage VBN at the output node 211 may decrease below 0.42 V. In response, the conductance of the second switch 102 may decrease, such that the reference voltage REF may increase (i.e., may be pulled up) to substantially return to the base value 1.8 V.

Referring to FIG. 2 and FIG. 3, when the reference voltage REF increases above 1.8 V (with the second current source 215 remaining on), the conductance of the first n-channel transistor 208 may increase, such that the second feedback voltage VBN provided at the output node 211 may increase. In response, the conductance of the fourth n-channel transistor 213 may increase, such that the voltage at the junction node 214 may decrease. In response, the conductance of the second n-channel transistor 209 may decrease, such that the second feedback voltage VBN at the output node 211 may increase above 0.42 V. In response, the conductance of the second switch 102 may increase, such that the reference voltage REF may decrease (i.e., may be pulled down) to substantially return to the base value 1.8 V.

According to different amplification factors, the change of the second feedback voltage VBN may be different from (e.g., greater than) the change of the reference voltage REF.

Referring to FIG. 3, part A of FIG. 3 illustrates the reference voltage REF, the first feedback voltage VBP, and the second feedback voltage VBN. The horizontal axis of part A of FIG. 3 indicates values of the reference voltage REF. The vertical axis of part A of FIG. 3 indicates values of the first feedback voltage VBP and the second feedback voltage VBN. Part B of FIG. 3 illustrates the electric current into the reference voltage output node (between the first switch 101 and the second switch 102). The horizontal axis of part B of FIG. 3 indicates values of the reference voltage REF. The vertical axis of part B of FIG. 3 indicates values of the electric current into the reference voltage output node (between the first switch 101 and the second switch 102). Part C of FIG. 3 illustrates a circled portion of part B of FIG. 3.

Referring to FIG. 3, when/if the reference voltage REF has the base value 1.8 V, then the first feedback voltage VBP has the base first feedback voltage value 2.87 V, the second feedback voltage VBN has the base second feedback voltage value 0.42, and the electric current into the reference voltage output node (between the first switch 101 and the second switch 102) has the base electric current value 0 mA. When/if the reference voltage REF has a decreased reference voltage value lower than 1.8 V, then the first feedback voltage VBP has a decreased first feedback voltage value lower than 2.87 V, the second feedback voltage VBN has a decreased second feedback voltage value lower than 0.42, and the electric current into the reference voltage output node (between the first switch 101 and the second switch 102) has an increased electric current value higher than 0 mA to enable the reference voltage output node 106 to receive a voltage (e.g., the first power supply voltage VDD from the first power supply terminal 105 through the first switch 101) to be pulled up, such that the reference voltage REF may be efficiently and effectively restored to the base value 1.8 V. When/if the reference voltage REF has an increased reference voltage value higher than 1.8 V, then the first feedback voltage VBP has an increased first feedback voltage value higher than 2.87 V, the second feedback voltage VBN has an increased second feedback voltage value higher than 0.42, and the electric current into the reference voltage output node (between the first switch 101 and the second switch 102) has a decreased electric current value lower than 0 mA to enable the reference voltage output node 106 to receive a voltage (e.g., the second power supply voltage VSS from the second power supply terminal 107 through the second switch 102) to be pulled down, such that the reference voltage REF may be efficiently and effectively restored to the base value 1.8 V.

Figure 4:
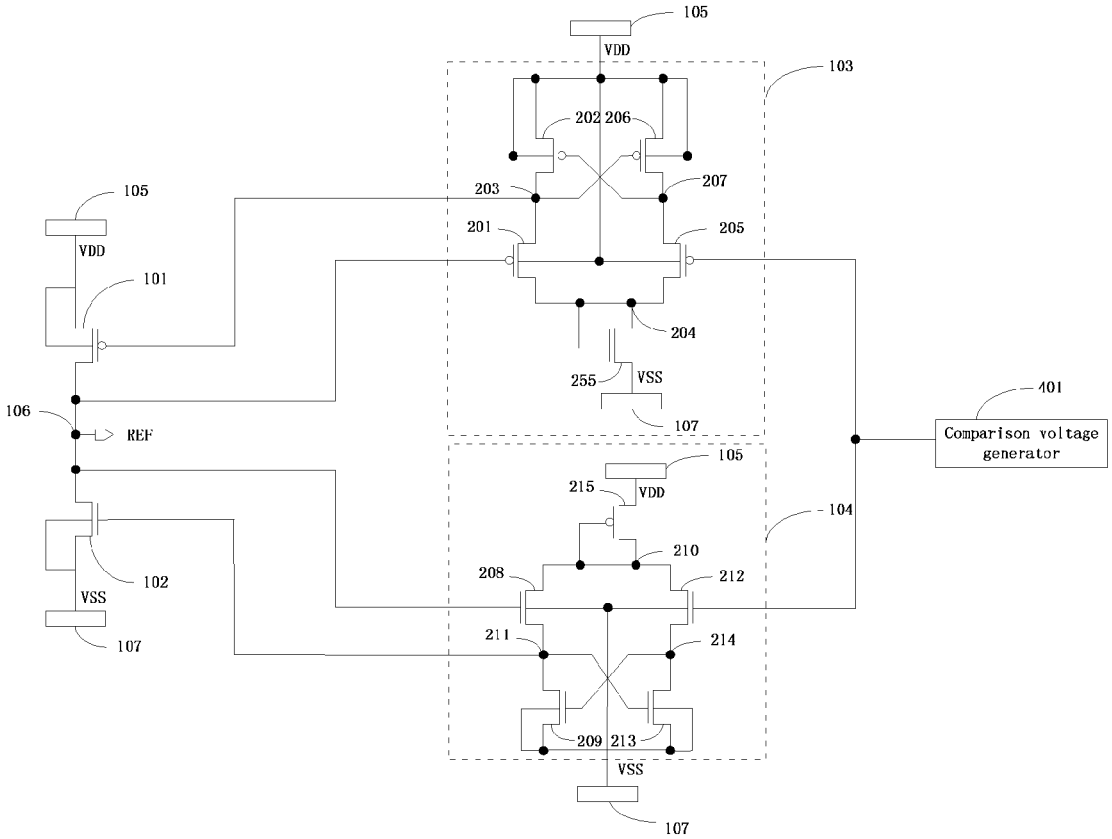
FIG. 4 shows a schematic diagram (e.g., a schematic circuit diagram) that illustrates elements and/or structures in a reference voltage generator in accordance with one or more embodiments.

FIG. 4 shows a schematic diagram (e.g., a schematic circuit diagram) that illustrates elements and/or structures in a reference voltage generator in accordance with one or more embodiments. Some features of the reference voltage generator may be analogous to or identical to some features described with reference to one or more of the examples of FIG. 1, FIG. 2, and FIG. 3. Referring to FIG. 4, the reference voltage generator may include a comparison voltage generator 401 for providing the comparison voltage COMPARE illustrated in FIG. 2. The comparison voltage generator 401 may be connected to each of the third p-channel transistor 205 and the third n-channel transistor 212.

Figure 5:
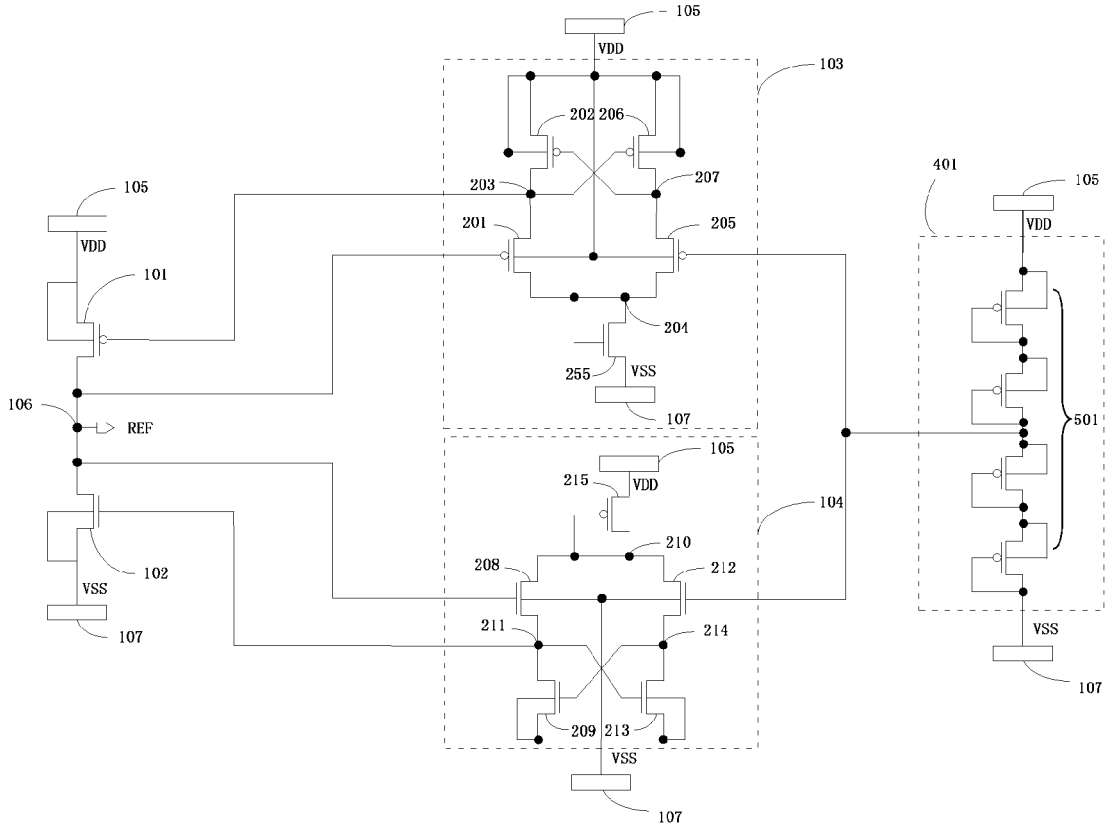
FIG. 5 shows a schematic diagram (e.g., a schematic circuit diagram) that illustrates elements and/or structures in a reference voltage generator in accordance with one or more embodiments.

FIG. 5 shows a schematic diagram (e.g., a schematic circuit diagram) that illustrates elements and/or structures in a reference voltage generator in accordance with one or more embodiments. Some features of the reference voltage generator may be analogous to or identical to some features described with reference to one or more of the examples of FIG. 1, FIG. 2, FIG. 3, and FIG. 4. Referring to FIG. 5, the comparison voltage generator 401 may include a plurality of diodes 501. The diodes 501 may be connected in series between the first power supply terminal 105 and the second power supply terminal 107.

In an embodiment, the comparison voltage generator 401 may include a plurality of resistors. The resistors may be connected in series between the first power supply terminal 105 and the second power supply terminal 107.

According to embodiments, although maximum allowable voltages of components (e.g., transistors) in a reference voltage generator may be lower than a power voltage difference, the components may operate under respective maximum allowable voltages, such that the reference voltage generator may operate reliably. According to embodiments, when a reference voltage provided by a reference voltage generator deviates from a base value of the reference voltage, the reference voltage generator may effectively and efficiently restore the reference voltage to the base value using positive feedback mechanisms. Advantageously, a substantially consistent and/or stable reference voltage may be provided.

While some embodiments have been described as examples, there are alterations, permutations, and equivalents. It should be noted that there are many alternative ways of implementing the methods and apparatuses. Furthermore, embodiments may find utility in other applications. The abstract section is provided herein for convenience and, due to word count limitation, is accordingly written for reading convenience and should not be employed to limit the scope of the claims. It is intended that the following appended claims be interpreted as including all alterations, permutations, and equivalents.

What is claimed is:

1. A reference voltage generator comprising:

a first power supply terminal configured to receive a first power supply voltage;

a second power supply terminal configured to receive a second power supply voltage;

a reference voltage output node configured to provide a reference voltage;

a first switch, wherein a first terminal of the first switch is electrically connected to the first power supply terminal, and wherein a second terminal of the first switch is electrically connected to the reference voltage output node;

a second switch, wherein a first terminal of the second switch is electrically connected to the second power supply terminal, and wherein a second terminal of the second switch is electrically connected to the reference voltage output node;

a first positive feedback module, wherein a first input node of the first positive feedback module is electrically connected to the reference voltage output node, and wherein an output node of the first positive feedback module is electrically connected to a control electrode of the first switch for providing a first feedback voltage to the control electrode of the first switch; and a second positive feedback module, wherein a first input node of the second positive feedback module is electrically connected to the reference voltage output node, wherein an output node of the second positive feedback module is electrically connected to a control electrode of the second switch for providing a second feedback voltage to the control electrode of the second switch, wherein the first positive feedback module is configured to provide the first feedback voltage with a base first feedback voltage value such that a conductance of the first switch has a base first conductance value when the reference voltage has a base reference voltage value, wherein the first positive feedback module is configured to provide the first feedback voltage with an increased first feedback voltage value such that the conductance of the first switch has a decreased first conductance value when the reference voltage has an increased reference voltage value, wherein the increased reference voltage value is higher than the base reference voltage value, wherein the increased first feedback voltage value is higher than the base first feedback voltage value, and wherein the decreased first conductance value is lower than the base first conductance value.

2. The reference voltage generator of claim 1, wherein the second feedback module is configured to provide the second feedback voltage with a base second feedback voltage value such that a conductance of the second switch has a base second conductance value when the reference voltage has the base reference voltage value, wherein the second positive feedback module is configured to provide the second feedback voltage with an increased second feedback voltage value such that the conductance of the second switch has an increased second conductance value when the reference voltage has an increased reference voltage value, wherein the increased reference voltage value is higher than the base reference voltage value, wherein the increased second feedback voltage value is higher than the base second feedback voltage value, and wherein the increased second conductance value is higher than the base second conductance value.

3. The reference voltage generator of claim 2, wherein the first positive feedback module is configured to provide the first feedback voltage with a decreased first feedback voltage value such that the conductance of the first switch has an increased first conductance value when the reference voltage has a decreased reference voltage value, wherein the decreased reference voltage value is lower than the base reference voltage value, wherein the decreased first feedback voltage value is lower than the base first feedback voltage value, and wherein the increased first conductance value is higher than the base first conductance value.

4. The reference voltage generator of claim 3, wherein the second positive feedback module is configured to provide the second feedback voltage with a decreased second feedback voltage value such that the conductance of the second switch has a decreased second conductance value when the reference voltage has the decreased reference voltage value, wherein the decreased reference voltage value is lower than the base reference voltage value, wherein the decreased second feedback voltage value is lower than the base second feedback voltage value, and wherein the decreased second conductance value is lower than the base second conductance value.

5. The reference voltage generator of claim 1, wherein the first power supply terminal and the second power supply terminal are configured to provide a first power voltage difference using the first power supply voltage and the second power supply voltage, and wherein one or more of a maximum allowable voltage of the first switch and a maximum allowable voltage of the second switch is lower than the first power voltage difference.

6. The reference voltage generator of claim 1, wherein the first positive feedback module is configured to provide the first feedback voltage with a first feedback voltage value equal to a value of the first power supply voltage minus a value of a threshold voltage of the first switch, and wherein the second positive feedback module is configured to provide the second feedback voltage with a second feedback voltage value equal to a value of a threshold voltage of the second switch plus the second power supply voltage.

7. A reference voltage generator comprising:

a first power supply terminal configured to receive a first power supply voltage;

a second power supply terminal configured to receive a second power supply voltage;

a reference voltage output node configured to provide a reference voltage;

a first switch, wherein a first terminal of the first switch is electrically connected to the first power supply terminal, and wherein a second terminal of the first switch is electrically connected to the reference voltage output node;

a second switch, wherein a first terminal of the second switch is electrically connected to the second power supply terminal, and wherein a second terminal of the second switch is electrically connected to the reference voltage output node;

a first positive feedback module, wherein a first input node of the first positive feedback module is electrically connected to the reference voltage output node, and wherein an output node of the first positive feedback module is electrically connected to a control electrode of the first switch for providing a first feedback voltage to the control electrode of the first switch; and a second positive feedback module, wherein a first input node of the second positive feedback module is electrically connected to the reference voltage output node, wherein an output node of the second positive feedback module is electrically connected to a control electrode of the second switch for providing a second feedback voltage to the control electrode of the second switch, wherein the first input node of the first positive feedback module is configured to receive a first copy of the reference voltage, wherein a second input node of the first positive feedback module is configured to receive a first copy of a comparison voltage, wherein the first positive feedback module is configured to generate the first feedback voltage based on a comparison between the first copy of the reference voltage and the first copy of the comparison voltage, wherein the first input node of the second positive feedback module is configured to receive a second copy of the reference voltage, wherein a second input node of the second positive feedback module is configured to receive a second copy of the comparison voltage, and wherein the second positive feedback module is configured to generate the second feedback voltage based on a comparison between the second copy of the reference voltage and the second copy of the comparison voltage.

8. A reference voltage generator comprising:

a first power supply terminal configured to receive a first power supply voltage;

a second power supply terminal configured to receive a second power supply voltage;

a reference voltage output node configured to provide a reference voltage;

a first switch, wherein a first terminal of the first switch is electrically connected to the first power supply terminal, and wherein a second terminal of the first switch is electrically connected to the reference voltage output node;

a second switch, wherein a first terminal of the second switch is electrically connected to the second power supply terminal, and wherein a second terminal of the second switch is electrically connected to the reference voltage output node;

a first positive feedback module, wherein a first input node of the first positive feedback module is electrically connected to the reference voltage output node, and wherein an output node of the first positive feedback module is electrically connected to a control electrode of the first switch for providing a first feedback voltage to the control electrode of the first switch; and a second positive feedback module, wherein a first input node of the second positive feedback module is electrically connected to the reference voltage output node, wherein an output node of the second positive feedback module is electrically connected to a control electrode of the second switch for providing a second feedback voltage to the control electrode of the second switch, wherein the first positive feedback module comprises:

a first connection node;

a second connection node;

a first p-channel transistor, which is electrically connected between the output node of the first positive feedback module and the first connection node;

a second p-channel transistor, which is electrically connected between the output node of the first positive feedback module and the first power supply terminal;

a third p-channel transistor, which is electrically connected between the second connection node and the first connection node;

a fourth p-channel transistor, which is electrically connected between the second connection node and the first power supply terminal; and a current source, which is electrically connected between the first connection node and the second power supply terminal, wherein a gate terminal of the first p-channel transistor functions as the first input node of the first positive feedback module for receiving a copy of the reference voltage, wherein a gate terminal of the third p-channel transistor functions as a second input node of the first positive feedback module for receiving a copy of a comparison voltage, wherein a gate terminal of the second p-channel transistor is electrically connected to the second connection node, and wherein a gate terminal of the fourth p-channel transistor is electrically connected to the output node of the first positive feedback module.

9. The reference voltage generator of claim 8, wherein the current source comprises an n-channel transistor.

10. The reference voltage generator of claim 8, wherein the first power supply terminal and the second power supply terminal are configured to provide a first power voltage difference using the first power supply voltage and the second power supply voltage, and wherein one or more of a maximum allowable voltage of the first p-channel transistor, a maximum allowable voltage of the second p-channel transistor, a maximum allowable voltage of the third p-channel transistor, and a maximum allowable voltage of the fourth p-channel transistor and a maximum allowable voltage of n-channel transistor as current source is lower than the first power voltage difference.

11. A reference voltage generator comprising:

a first power supply termianl configured to receive a first power supply voltage;

a second power supply terminal configured to receive a second power supply voltage;

a reference voltage output node configured to provide a reference voltage;

a first switch wherein a first terminal of the first switch is electrically connected to the first power supply terminal, and wherein a second terminal of the first switch is electrically connected to the reference voltage output node;

a second switch, wherein a first terminal of the second switch is electrically connected to the second power supply terminal, and wherein a second terminal of the second switch is electrically connected to the reference voltage output node;

a first positive feedback module, wherein a first input node of the first positive feedback module is electrically connected to the reference voltage output node, and wherein an output node of the first positive feedback module is electrically connected to a control electrode of the first switch for providing a first feedback voltage to the control electrode of the first switch; and a second positive feedback module, wherein a first input node of the second positive feedback module is electrically connected to the reference voltage output node, wherein an output node of the second positive feedback module is electrically connected to a control electrode of the second switch for providing a second feedback voltage to the control electrode of the second switch, wherein the second positive feedback module comprises:

a first junction node;

a second junction node;

a first n-channel transistor, which is electrically connected between the output node of the second positive feedback module and the first junction node;

a second n-channel transistor, which is electrically connected between the output node of the second positive feedback module and the second power supply terminal;

a third n-channel transistor, which is electrically connected between the second junction node and the first junction node;

a fourth n-channel transistor, which is electrically connected between the second junction node and the second power supply terminal; and a current source, which is electrically connected between the first junction node and the first power supply terminal, wherein a gate terminal of the first n-channel transistor functions as the first input node of the second positive feedback module for receiving a copy of the reference voltage, wherein a gate terminal of the third n-channel transistor functions as a second input node of the second positive feedback module for receiving a copy of a comparison voltage, wherein a gate terminal of the second n-channel transistor is electrically connected to the second junction node, and wherein a gate terminal of the fourth n-channel transistor is electrically connected to the output node of the second positive feedback module.

12. The reference voltage generator of claim 11, wherein the current source comprises a p-channel transistor.

13. The reference voltage generator of claim 11, wherein the first power supply terminal and the second power supply terminal are configured to provide a first power voltage difference using the first power supply voltage and the second power supply voltage, and wherein one or more of a maximum allowable voltage of the first n-channel transistor, a maximum allowable voltage of the second n-channel transistor, a maximum allowable voltage of the third n-channel transistor, and a maximum allowable voltage of the fourth n-channel transistor and a maximum allowable voltage of p-channel transistor as current source is lower than the first power voltage difference.

14. A reference voltage generator comprising:

a first power supply terminal configured to receive a first power supply voltage;

a second power supply terminal configured to receive a second power supply voltage;

a reference voltage output node configured to provide a reference voltage;

a first switch, wherein a first terminal of the first switch is electrically connected to the first power supply terminal, and wherein a second terminal of the first switch is electrically connected to the reference voltage output node;

a second switch, wherein a first termianl of the second switch is electrically connected to the second power supply terminal, and wherein a second terminal of the second switch is electrically connected to the reference voltage output node;

a first positive feedback module, wherein a first input node of the first positive feedback module is electrically connected to the reference voltage output node, and wherein an output node of the first positive feedback module is electrically connected to a control electrode of the first switch for providing a first feedback voltage to the control electrode of the first switch;

a second positive feedback module, wherein a first input node of the second positive feedback module is electrically connected to the reference voltage output node, wherein an output node of the second positive feedback module is electrically connected to a control electrode of the second switch for providing a second feedback voltage to the control electrode of the second switch; and a comparison voltage generator electrically connected to both a second input node of the first positive feedback module and a second input node of the second positive feedback module and configured to provide a comparison voltage, wherein the second input node of the first positive feedback module is configured to receive a first copy of the comparison voltage, and wherein the second input node of the second positive feedback module is configured to receive a second copy of the comparison voltage.

15. The reference voltage generator of claim 14, wherein the comparison voltage generator comprises a plurality of transistors, a plurality of diodes, or a plurality of resistors, wherein the transistors, the diodes, or the resistors are electrically connected in series between the first power supply terminal and the second power supply terminal.

* * * * *